US012686095B1

(12) United States Patent
Li et al.

(10) Patent No.: US 12,686,095 B1
(45) Date of Patent: Jul. 21, 2026

(54) ANGLE-ADAPTIVE AND PRESSURE-ADJUSTABLE POLISHING GRINDING HEAD FOR OPTICAL ELEMENTS

(71) Applicant: JiMei University, Xiamen (CN)

(72) Inventors: Xianling Li, Xiamen (CN); Jingchang Chen, Xiamen (CN); Dalong Zhang, Xiamen (CN)

( * ) Notice: Subject to any disclaimer, the term of this patent is extended or adjusted under 35 U.S.C. 154(b) by 0 days.

(21) Appl. No.: 19/078,356

(22) Filed: Mar. 13, 2025

(51) Int. Cl.
*B24B 13/01* (2006.01)

(52) U.S. Cl.
CPC ..... *B24B 13/01* (2013.01)

(58) Field of Classification Search
CPC ..... B24B 13/043; B24B 13/02; B24B 13/012; B24B 13/0018; B24B 13/01
See application file for complete search history.

(56) References Cited

FOREIGN PATENT DOCUMENTS

| | | | | |
|---|---|---|---|---|
| CN | 116460694 A | * | 7/2023 | ..... B24B 13/01 |
| EP | 0156746 A1 | | 10/1985 | |
| JP | H06114716 A | | 4/1994 | |

OTHER PUBLICATIONS

CNIPA Second Office Action, Application No. 202510095604.7, Dated Aug. 13, 2025, English Translation, pp. 1-7.
CNIPA Second Office Action, Application No. 202510095604.7, Dated Aug. 13, 2025, Original Chinese, pp. 1-4.

* cited by examiner

*Primary Examiner* — Joel D Crandall

(57) ABSTRACT

An angle-adaptive and pressure-adjustable polishing grinding head for optical elements is provided. The head includes a bottom plate, a positioning mounting pin is arranged in a center of an upper surface of the bottom plate, a gas nozzle is arranged on the upper surface of the bottom plate, a corrugated pipe interface is arranged on a lower surface of the bottom plate, the corrugated pipe interface is connected to a top of a corrugated pipe, a bottom of the corrugated pipe is mounted with a grinding head base, and a lower part of the grinding head base is connected to a grinding head through a snap ring. The above-mentioned angle-adaptive and pressure-adjustable polishing grinding head for optical elements automatically adjusts the angle of the grinding head by utilizing a flexible structure of a corrugated pipe to dynamically fit with the surface of the optical element.

3 Claims, 6 Drawing Sheets

ANGLE-ADAPTIVE AND PRESSURE-ADJUSTABLE POLISHING GRINDING HEAD FOR OPTICAL ELEMENTS

CROSS-REFERENCE TO THE RELATED APPLICATIONS

This application is based upon and claims priority to Chinese Patent Application No. 202510095604.7, filed on Jan. 21, 2025, the entire contents of which are incorporated herein by reference.

TECHNICAL FIELD

The present invention relates to the field of precision manufacturing technology, particularly to an angle-adaptive and pressure-adjustable polishing grinding head for optical elements.

BACKGROUND

In large-scale optical engineering projects, such as aerospace, high-intensity laser facilities and photoetching machines, high-precision optical elements are widely used, and strict requirements are raised for the accuracy standard of optical elements. The optical element is the most important part of the optical system, and its performance directly determines the accuracy and resolution of the optical system. Therefore, the optical elements used in the optical system must have extremely high surface accuracy, and the most stringent requirement reaches the sub-nanometer level.

Polishing is a key process in the precision processing of optical elements, so polishing accuracy has a great influence on the final precision of optical elements. Computer-controlled optical surfacing is the most widely used technique in the numerous polishing methods. In the polishing process, the angle and pressure of the polishing grinding head are very critical, because different polishing angles will affect the curvature, flatness and surface roughness of the optical surface, and the contact pressure between the grinding head and the surface of the optical element in the polishing process directly affects the surface quality. Higher pressures may result in scratches or surface damage, while too low a pressure may result in a poor polishing effect. In view of this, the development of a polishing grinding head for optical elements capable of automatically adapting to an angle change and flexibly adjusting the pressure has become an ideal solution to the above-mentioned problems.

SUMMARY

An objective of the present invention is to provide an angle-adaptive and pressure-adjustable polishing grinding head for optical elements, which automatically adjusts the angle of the grinding head by utilizing a flexible structure of a corrugated pipe to dynamically fit with the surface of the optical element and adapt to a complex curvature surface; by adjusting medium pressure in the corrugated pipe, the contact pressure between the grinding head and the surface can be accurately controlled to avoid excessive grinding or damage, and the polishing quality and efficiency of complex optical elements are ultimately improved.

In order to achieve the above objective, the present invention provides an angle-adaptive and pressure-adjustable polishing grinding head for optical elements, including a bottom plate, a positioning mounting pin is arranged in a center of an upper surface of the bottom plate, a gas nozzle is arranged on the upper surface of the bottom plate, a corrugated pipe interface is arranged on a lower surface of the bottom plate, the corrugated pipe interface is connected to a top of a corrugated pipe, a bottom of the corrugated pipe is mounted with a grinding head base, and a lower part of the grinding head base is connected to a grinding head through a snap ring.

Preferably, the upper surface of the bottom plate is provided with a threaded hole, the threaded hole is uniformly distributed, the lower end of the gas nozzle is provided with an external thread, the gas nozzle is adjacently connected to the threaded hole through the external thread, a nut is arranged above the external thread, and a quick-connecting coupling is arranged above the nut.

Preferably, the lower surface of the bottom plate is provided with the corrugated pipe interface correspondingly to the threaded hole, and the gas nozzle is connected to the corrugated pipe interface.

Preferably, the upper surface of the grinding head base is provided with a corrugated pipe core, the corrugated pipe core cooperates with the corrugated pipe and is located inside the corrugated pipe, and an upper end of the corrugated pipe core is mounted with a sealing ring.

Preferably, the lower surface of the grinding head base is provided with a chamfer, and the upper surface of the grinding head is provided with a step, the top surface of the step cooperates with the lower surface of the grinding head base.

Preferably, the inner surface of the snap ring cooperates with a side of the step and a side of the grinding head base, and the snap ring is provided with an inner buckle matched with the step.

Therefore, the present invention adopts the above-mentioned angle-adaptive and pressure-adjustable polishing grinding head for optical elements, which has the following advantages:

(1) dynamic adaptive angle adjustment: compared with the design of the conventional fixed angle grinding head, in the present invention, the flexible characteristic of corrugated pipe is used to realize the dynamic fitting between the grinding head and optical elements, particularly suitable for the processing of optical elements with complex curved surfaces, and the adaptability and flexibility of processing are improved.

(2) Accuracy contact pressure control: the contact pressure is adjusted through the gas or liquid pressure inside the corrugated pipe, it is more accurate and stable than the conventional mechanical spring-loaded method, meanwhile, the surface damage caused by excessive grinding force is avoided, and the processing quality is improved.

(3) Adapt to more complex optical elements: there is a growing requirement for high-end optical elements (such as aspheric lenses, free-form curved surfaces, etc.), the elements processing requires the grinding head to have the characteristic of dynamic angle adjustment and uniform pressure distribution. The polishing grinding head design of the present invention just meets these requirements and significantly improves processing efficiency and quality.

(4) Compact structure and multi-functional integration: the vacuum corrugated pipe has the functions of adjusting angle and pressure at the same time, which reduces the requirement for additional components in the system, and has a more compact structure, which is suitable for integration into different types of optical processing equipment.

(5) Avoid secondary processing: due to the improper adjustment of contact pressure and angle, the conventional polishing method is easy to cause sub-surface damage or minor geometric errors, while this technology reduces the sub-surface defects and reduces the requirement for secondary polishing and finishing through accuracy angle and pressure control.

Further detailed descriptions of the technical scheme of the present invention can be found in the accompanying drawings and embodiments.

REFERENCE NUMERALS IN FIGURES

1, a bottom plate; 11, a positioning mounting pin; 12, a corrugated pipe interface; 13, a threaded hole; 2, a gas nozzle; 21, an external thread; 22, a nut; 23, a quick-connecting coupling; 3, a corrugated pipe; 4, a grinding head base; 41, a chamfer; 42, a corrugated pipe core; 43, a sealing ring; 5, a snap ring; 51, an inner buckle; 6, a grinding head; 61, a step.

DETAILED DESCRIPTION OF THE EMBODIMENTS

The technical scheme of the present invention is further explained below by drawings and embodiments.

Unless otherwise defined, the technical or scientific terms used in the present invention shall be those to which the present invention belongs. As used herein, the terms 'first', 'second', and the like do not denote any order, quantity, or importance, but rather are used to distinguish one element from another. Similar words such as 'comprise' or 'include' means that the elements or items preceding the word encompass the elements or items listed after the word and equivalents thereof, but do not exclude other elements or items. Similar terms such as 'connected' or 'connecting' are not limited to physical or mechanical connections, but can include electrical connections, whether direct or indirect. 'Up', 'down', 'left', 'right', etc. are only used to indicate a relative positional relationship, which may change accordingly when the absolute position of the object being described changes.

Embodiment 1

Figure 1:
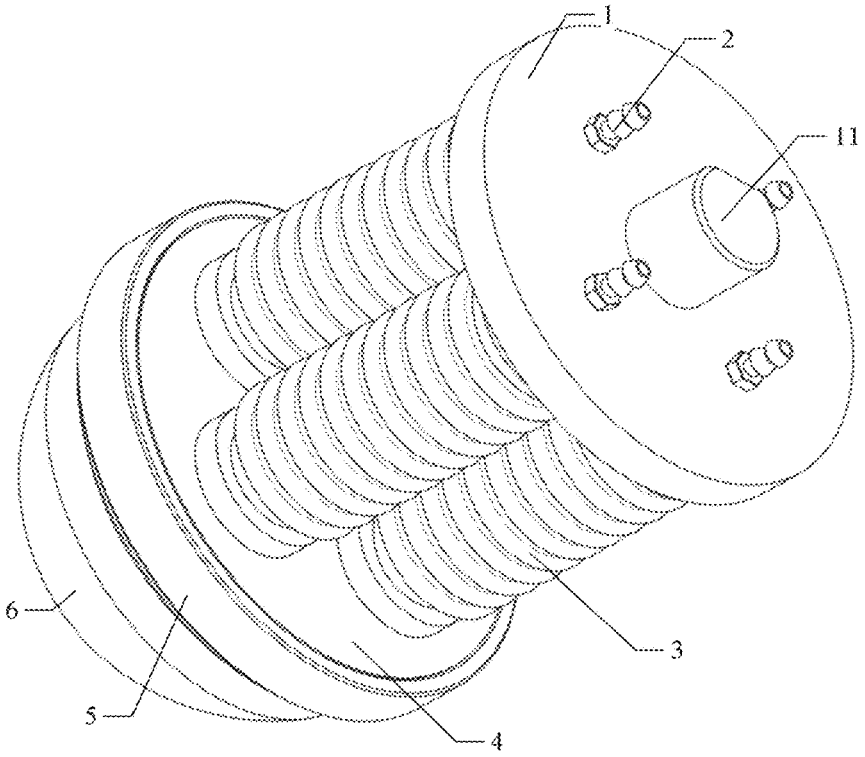
FIG. 1 is an appearance diagram of an embodiment of an angle-adaptive and pressure-adjustable polishing grinding head for optical elements of the present invention.
Figure 2:
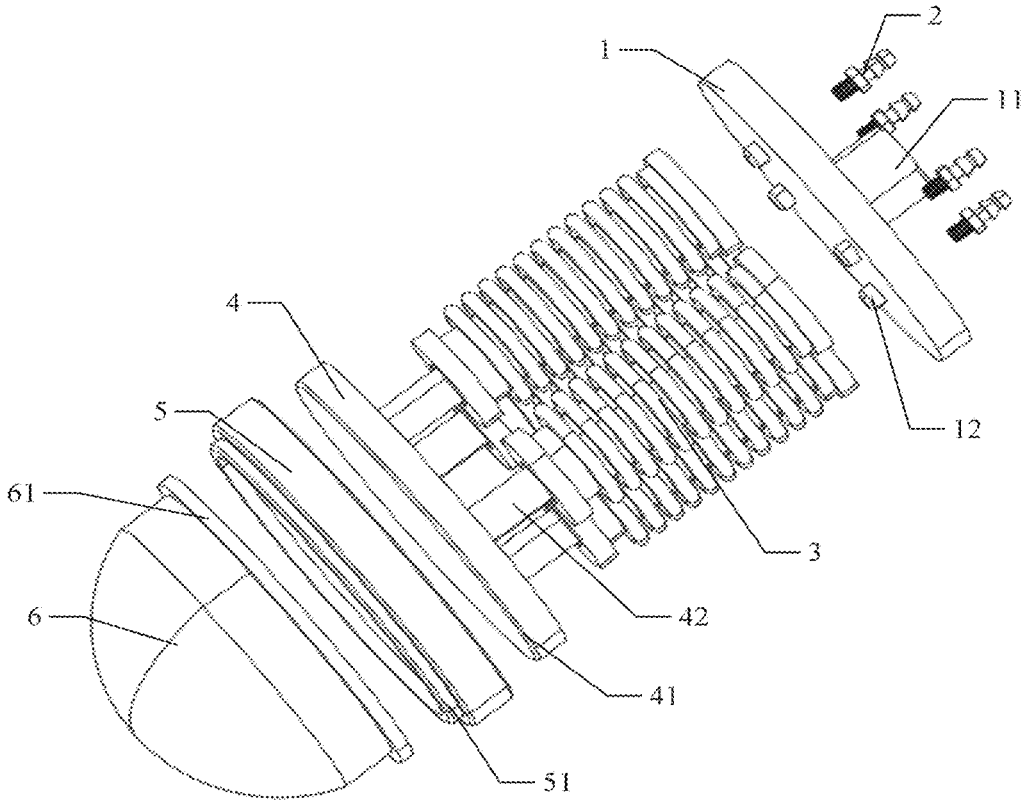
FIG. 2 is a structural explosion diagram of an embodiment of an angle-adaptive and pressure-adjustable polishing grinding head for optical elements of the present invention.
Figure 3:
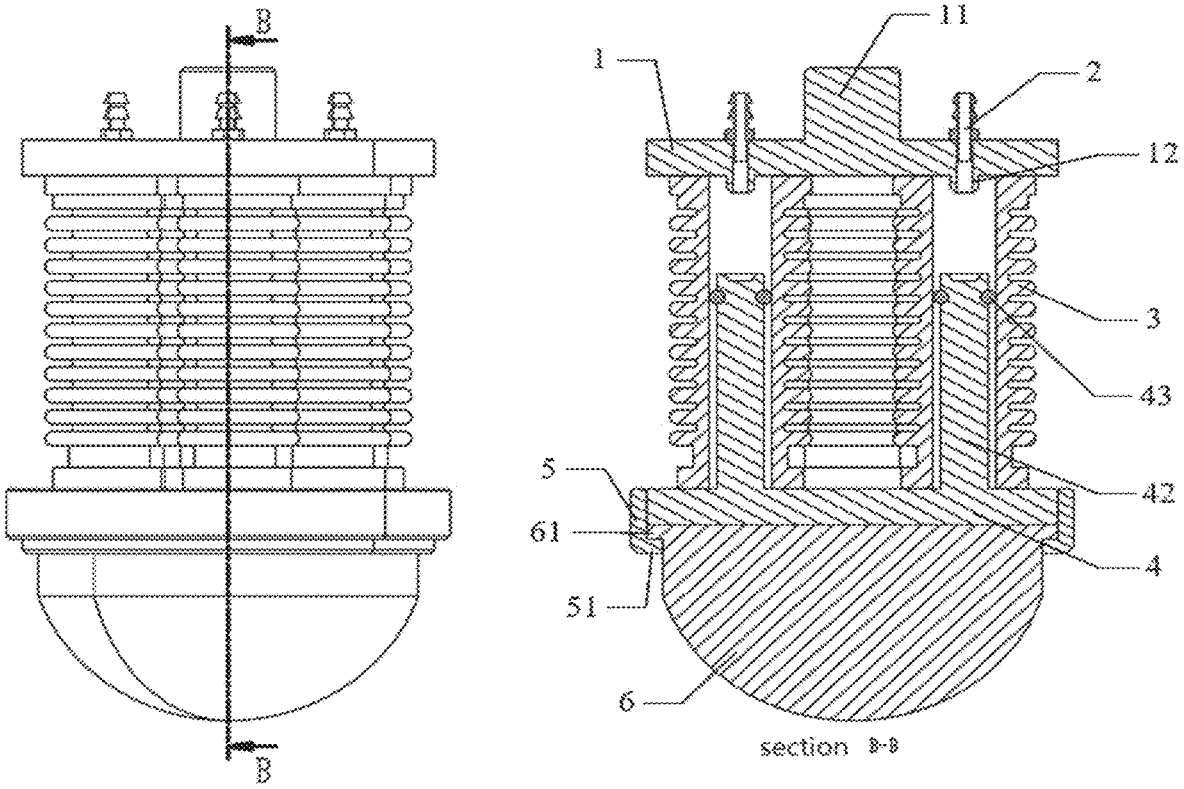
FIG. 3 is a schematic diagram of an internal structure of an embodiment of an angle-adaptive and pressure-adjustable polishing grinding head for optical elements of the present invention.
Figure 5:
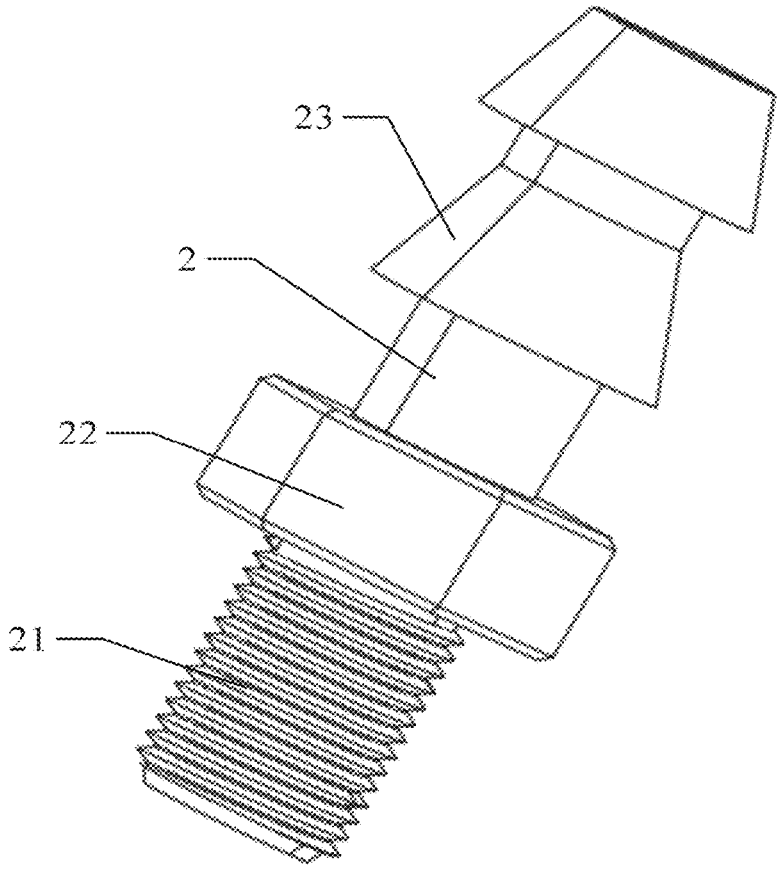
FIG. 5 is a schematic diagram of a gas nozzle of an embodiment of an angle-adaptive and pressure-adjustable polishing grinding head for optical elements of the present invention.
Figure 6:
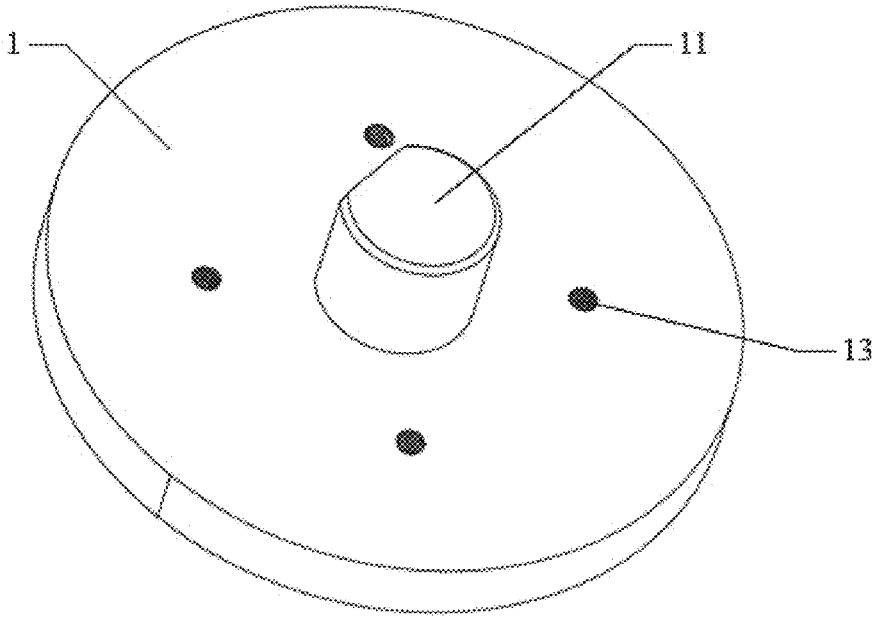
FIG. 6 is a schematic diagram of a bottom plate of an embodiment of an angle-adaptive and pressure-adjustable polishing grinding head for optical elements of the present invention.

The present invention provides an angle-adaptive and pressure-adjustable polishing grinding head for optical elements, the structure is shown in FIG. 1-3, including a bottom plate 6, the bottom plate is shown in FIG. 6, a positioning mounting pin 11 is arranged in a center of an upper surface of the bottom plate 6, the upper surface of the bottom plate 6 is provided with a threaded hole 13, the threaded hole 13 is uniformly distributed, a gas nozzle 2 is mounted in threaded hole 13. The structure of gas nozzle 2 is shown in FIG. 5, the lower end of the gas nozzle 2 is provided with an external thread 21, the gas nozzle 2 is adjacently connected to the threaded hole 13 through the external thread 21, a nut 22 is arranged above the external thread 21 to facilitate the use of a wrench to tighten the gas nozzle 2, and a quick-connecting coupling 23 is arranged above the nut 22 to used for connecting the external pressure source.

Figure 4:
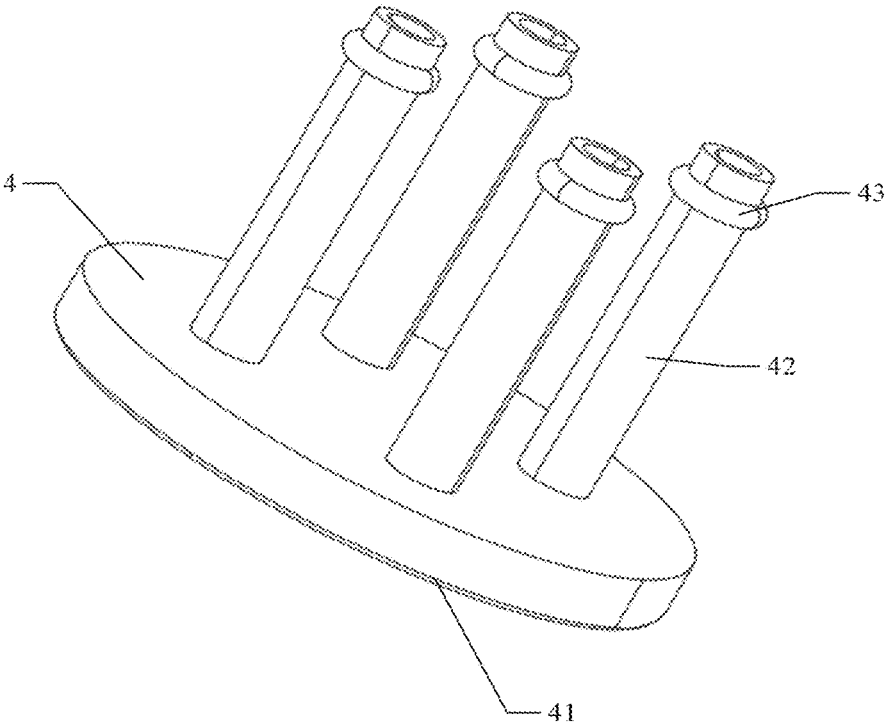
FIG. 4 is a schematic diagram of a grinding head base of an embodiment of an angle-adaptive and pressure-adjustable polishing grinding head for optical elements of the present invention.

The lower surface of the bottom plate 1 is provided with the corrugated pipe interface 12 correspondingly to the threaded hole 13, and the gas nozzle 2 is connected to the corrugated pipe interface 12, the corrugated pipe interface 12 is connected to a top of a corrugated pipe 3. A bottom of the corrugated pipe 3 is mounted with a grinding head base 4, the grinding head base is shown as FIG. 4, the upper surface of the grinding head base 4 is provided with a corrugated pipe core 42, the corrugated pipe core 42 cooperates with the corrugated pipe 3 and is located inside the corrugated pipe 3, and an upper end of the corrugated pipe core 42 is mounted with a sealing ring 43, the lower surface of the grinding head base 4 is provided with a chamfer 41.

The upper surface of the grinding head 6 is provided with a step 61, the top surface of the step 61 cooperates with the lower surface of the grinding head base 4. The grinding head 6 and the grinding head base 4 are connected by the snap ring 5, the inner surface of the snap ring 5 cooperates with a side of the step 61 and a side of the grinding head base 4, and the snap ring 5 is provided with an inner buckle 51 matched with the step 61.

When using the angle-adaptive and pressure-adjustable polishing grinding head for optical elements described in the present invention for optical element processing, the functions and specific working processes of each component are as follows:

the corrugated pipe 3 is a vacuum corrugated pipe, which can realize the function of angle adjustment and pressure adjustment of the grinding head 6. The grinding head 6 is directly in contact with the optical element to polish the surface of the optical element. The external pressure source is the pressure gas or liquid medium charged in the corrugated pipe 3 to achieve accurate adjustment of the contact pressure. The bottom plate 1 is connected to one end of the corrugated pipe 3 by welding to play a connecting role between the corrugated pipe 3 and the pressure source, the other end of the corrugated pipe 3 is connected to the grinding head 6 by welding, a closed cavity is formed between the grinding head 6 and the bottom plate 1, the pressure medium enters the cavity through the gas nozzle 2 and the corrugated pipe interface 12.

The whole processing consists of the following steps:

S1, the optical element to be processed is placed on the fixture to ensure that the processed optical element is completely immersed in the polishing liquid and fixed, then the grinding head 6 of the present invention is moved to the surface of the element, so that the grinding head 6 is lightly contacted to the surface of the element to complete the tool setting.

Figure 7:
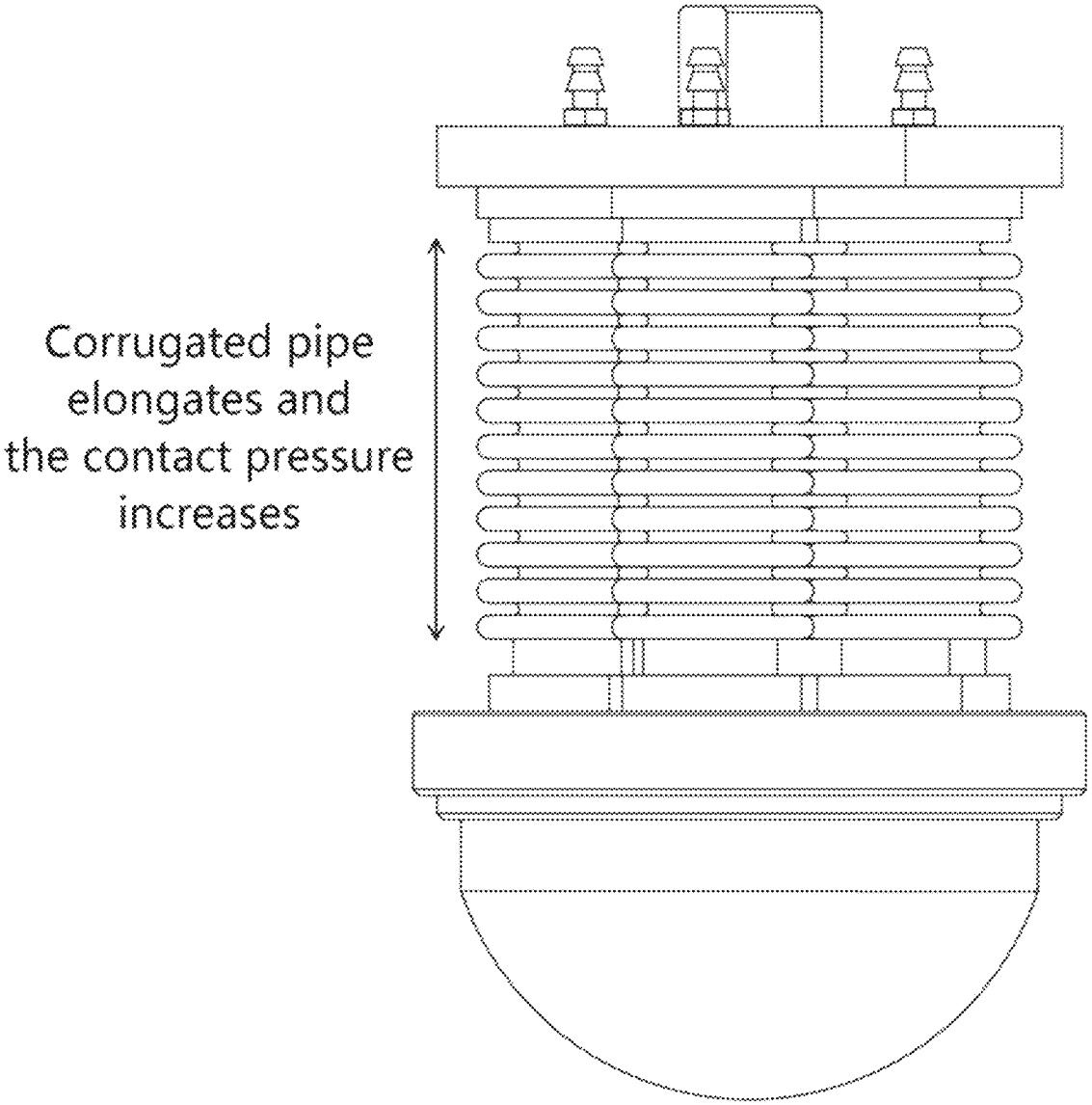
FIG. 7 is a schematic diagram of increasing contact pressure of an embodiment of an angle-adaptive and pressure-adjustable polishing grinding head for optical elements of the present invention.
Figure 8:
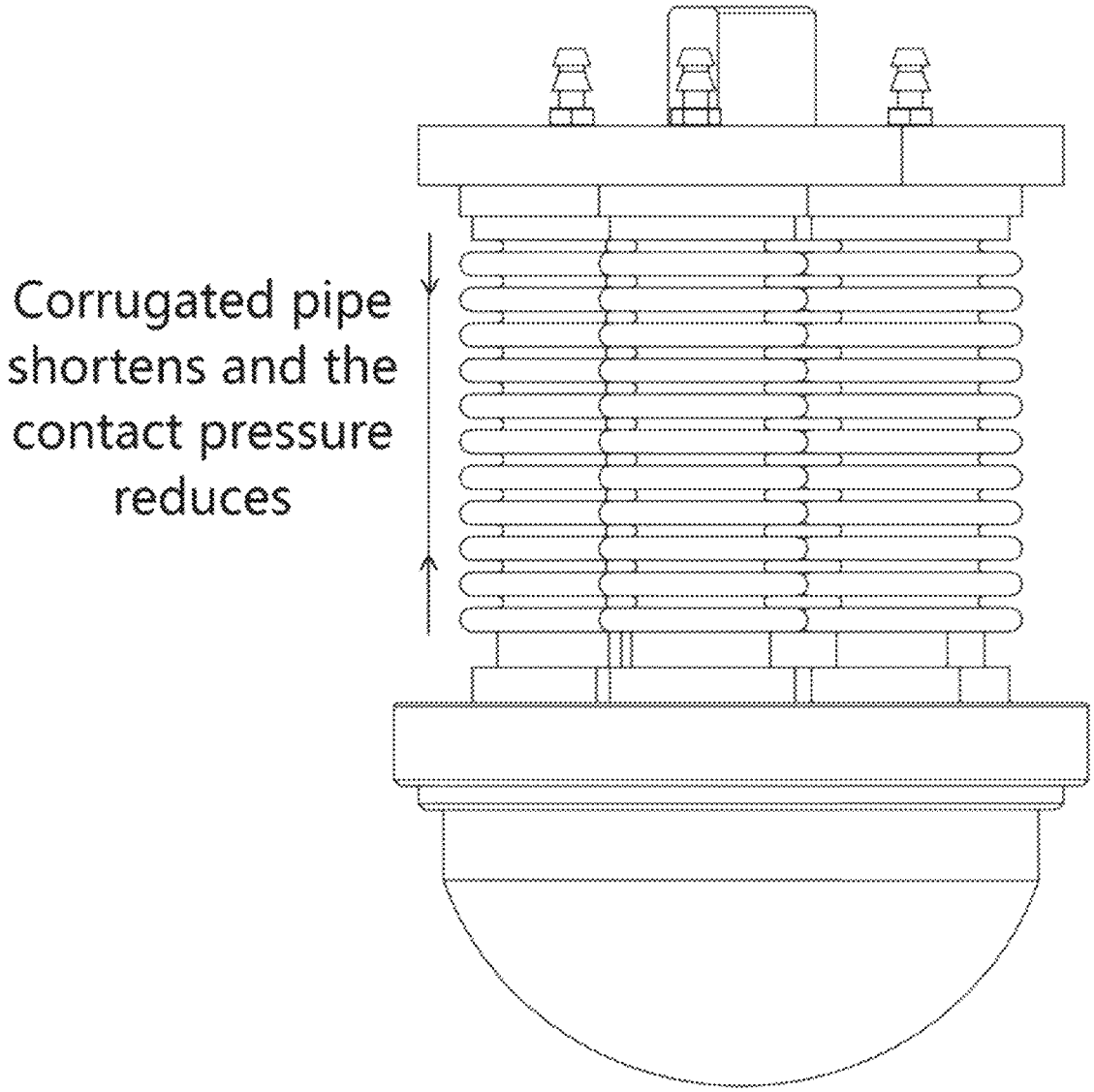
FIG. 8 is a schematic diagram of reducing contact pressure of an embodiment of an angle-adaptive and pressure-adjustable polishing grinding head for optical elements of the present invention.

S2. The pressure source is switched on and to charge the pressure medium for the corrugated pipe to change the contact pressure of the grinding head 6 with the surface of the element. According to the actual situation, the contact pressure is adjusted to achieve the purpose of improving processing quality. The contact pressure adjustment changes the length of the corrugated pipe 3 by charging or discharging the pressure medium to the corrugated pipe 3, and as shown in FIGS. 7 and 8, when the pressure medium is charged into the corrugated pipe 3, the corrugated pipe 3 stretches and lengthens due to the increase of the internal pressure; on the contrary, if the pressure medium is discharged from the corrugated pipe 3, the corrugated pipe 3 contractss and shortens due to the reduce of the pressure. By using the mechanical properties of the elongation and contraction of the corrugated pipe 3, the contact pressure applied by the grinding head 6 to the surface of the optical element can be effectively adjusted so as to avoid excessive grinding or surface damage and ensure the quality of the processing.

Figure 9:
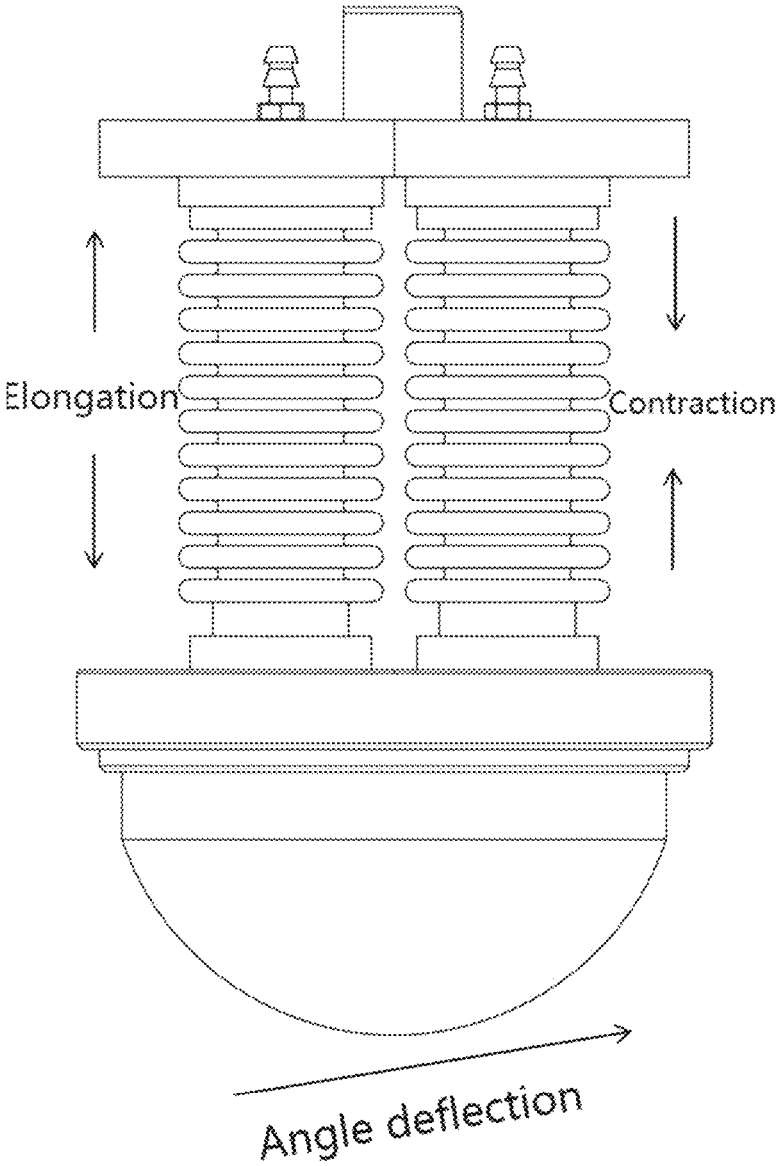
FIG. 9 is an angle adjustment schematic diagram of an embodiment of an angle-adaptive and pressure-adjustable polishing grinding head for optical elements of the present invention.

S3, the rotating mechanism is started to rotate the element to be polished at a high speed, and the grinding head 6 polishes the entire optical element according to the set polishing path. When polishing different positions, the grinding head 6 can self-adjust the polishing angle according to the curvature of the polishing area. The adaptive adjustment of the angle of the grinding head 6 is achieved through the corrugated pipe 3. Due to the inherent flexibility of the corrugated pipe 3, the corrugated pipe 3 can bend in a corresponding direction when subjected to a radial force or bending moment, as shown in FIG. 9. This characteristic gives the grinding head 6 the ability to automatically adapt to different shapes of optical elements, and ensures that the contact angle between the grinding head 6 and the surface of the element is always kept at an optimal state, so as to adapt to complex processing requirements.

Therefore, the present invention adopts the above-mentioned angle-adaptive and pressure-adjustable polishing grinding head for optical elements, wherein the flexible structure of the corrugated pipe is used to automatically adjust the angle of the grinding head, which is dynamically fitted with the surface of the optical element to adapt to the complex curvature surface; by regulating the medium pressure in the corrugated pipe, the contact pressure between the grinding head and the surface is accurately controlled to avoid excessive grinding or damage. The closed cavity ensures the stability of the system, and the dynamic adjustment ability ensures the real-time optimization of the angle and pressure during processing, thereby significantly improving the polishing quality and efficiency of complex optical elements.

Finally, it should be noted that the above examples are merely used for describing the technical solutions of the present invention, rather than limiting the same. Although the present invention has been described in detail with reference to the preferred examples, those of ordinary skill in the art should understand that the technical solutions of the present invention may still be modified or equivalently replaced. However, these modifications or substitutions should not make the modified technical solutions deviate from the spirit and scope of the technical solutions of the present invention.

What is claimed is:

1. An angle-adaptive and pressure-adjustable polishing grinding head for optical elements, comprising a bottom plate, wherein a positioning mounting pin is arranged in a center of an upper surface of the bottom plate, a gas nozzle is arranged on the upper surface of the bottom plate, a corrugated pipe interface is arranged on a lower surface of the bottom plate, the corrugated pipe interface is connected to a top of a corrugated pipe, a bottom of the corrugated pipe is mounted with a grinding head base, and a lower part of the grinding head base is connected to a grinding head through a snap ring;

wherein the upper surface of the bottom plate is provided with a threaded hole, the threaded hole is uniformly distributed, a lower end of the gas nozzle is provided with an external thread, the gas nozzle is adjacently connected to the threaded hole through the external thread, a nut is arranged above the external thread, and a quick-connecting coupling is arranged above the nut, wherein an upper surface of the grinding head base is provided with a corrugated pipe core, the corrugated pipe core cooperates with the corrugated pipe and is located inside the corrugated pipe, and an upper end of the corrugated pipe core is mounted with a sealing ring;

wherein the lower surface of the bottom plate is provided with the corrugated pipe interface correspondingly to the threaded hole, and the gas nozzle is connected to the corrugated pipe interface.

2. The angle-adaptive and pressure-adjustable polishing grinding head for the optical elements according to claim 1, wherein a lower surface of the grinding head base is provided with a chamfer, and an upper surface of the grinding head is provided with a step, a top surface of the step cooperates with the lower surface of the grinding head base.

3. The angle-adaptive and pressure-adjustable polishing grinding head for the optical elements according to claim 2, wherein an inner surface of the snap ring cooperates with a side of the step and a side of the grinding head base, and the snap ring is provided with an inner buckle matched with the step.

* * * * *